US006726070B2

(12) United States Patent
Lautner

(10) Patent No.: US 6,726,070 B2
(45) Date of Patent: Apr. 27, 2004

(54) ERGONOMIC INPUT-DEVICE HOLDER

(75) Inventor: Robert Martin Lautner, Atlanta, GA (US)

(73) Assignee: Robert Lautner, Atlanta, GA (US)

( * ) Notice: Subject to any disclaimer, the term of this patent is extended or adjusted under 35 U.S.C. 154(b) by 24 days.

(21) Appl. No.: 10/150,439

(22) Filed: May 20, 2002

(65) Prior Publication Data

US 2003/0213822 A1 Nov. 20, 2003

(51) Int. Cl.[7] ..... A45F 3/14; A44C 5/18; A45C 13/30

(52) U.S. Cl. ..... 224/221; 224/222; 224/930

(58) Field of Search ..... 224/219, 221, 224/222, 218, 267, 165, 930; 400/88

(56) References Cited

U.S. PATENT DOCUMENTS

| | | | | | |
|---|---|---|---|---|---|
| 1,701,888 | A | * | 2/1929 | Hofferberth | 248/444 |
| 1,823,814 | A | * | 9/1931 | Aiello | 132/301 |
| 4,136,805 | A | * | 1/1979 | Storms | 224/219 |
| 4,444,520 | A | * | 4/1984 | Hanakata et al. | 400/88 |
| 4,611,406 | A | | 9/1986 | Engstrom et al. | |
| 4,909,514 | A | * | 3/1990 | Tano | 273/148 B |
| 5,261,581 | A | * | 11/1993 | Harden, Sr. | 224/219 |
| 5,657,201 | A | * | 8/1997 | Kochis | 361/686 |
| 5,667,114 | A | | 9/1997 | Bourque | |
| 6,000,665 | A | | 12/1999 | Clementson et al. | |
| 6,028,765 | A | | 2/2000 | Swindler et al. | |
| 6,161,740 | A | * | 12/2000 | Allen | 224/197 |
| 6,282,082 | B1 | | 8/2001 | Armitage et al. | |
| 6,360,928 | B1 | * | 3/2002 | Russo | 224/218 |

FOREIGN PATENT DOCUMENTS

| | | | |
|---|---|---|---|
| EP | 0555106 | A1 * | 8/1993 |
| EP | 0734694 | A2 | 2/1996 |

* cited by examiner

*Primary Examiner*—Sue A. Weaver

(57) ABSTRACT

An ergonomic input device holder where a portable input device such as a tablet computer is attached to the top side and the user grips the input device holder by a pistol grip handle on the bottom side. The user's hand is furthermore supported by a pair of wrist supports and the wrist may optionally be strapped in place with straps, The handle and the wrist supports can be rotated to fit both right and left handed users as well as to allow for use in both portrait mode and landscape mode.

9 Claims, 1 Drawing Sheet

17
2
2
3
7
6
5

3
1
6
7
9
13
5
14
4

17
1
4
10
12
2
16
15
11
2
3

15
3
7
8
6
5
15
13
1
4

ERGONOMIC INPUT-DEVICE HOLDER

RELATED APPLICATIONS

This application claims the benefit of U.S. Provisional Application No. 60/290,259 filed on May 9, 2001.

BACKGROUND OF THE INVENTION

Input devices such as portable tablet computers or old fashioned clipboards or paper notebooks when not used on a work surface such as a desk are generally gripped from behind with the non-preferred hand by means of the fingers of the non preferred hand bending around an edge of the input device while the preferred hand is used to operate the tablet computer or to write on the notepad or clipboard. This way of gripping an input device is not ergonomically correct and can cause work injuries such as Carpal Tunnel Syndrome to people using input devices frequently in this manner. With the rapid spread of portable tablet computers wrist injuries could become more frequent than ever before.

The present invention presents a way to grip an input device such as a portable tablet computer in an ergonomically better way and thereby reduces the physical stresses on the wrist.

PRIOR ART

U.S. Pat. No. 4,611,406 to Engstrom et al. discloses an enclosure for an electrical data input apparatus. This enclosure is a housing for raw electronics that have been specially designed to fit the enclosure, it is not an enclosure that a user can attach to any input device.

U.S. Pat. No. 6,028,765 to Swindler et al. discloses a pair of removable hand grips for a portable tablet computer. These hand grips do make the grip of an input device more ergonomic by improving the already existing gripping surfaces of the input device. It improves the grip between the hand and the input device but does not change the ergonomically incorrect angle of the wrist which is the cause of many work injuries.

U.S. Pat. No. 6,282,082 to Armitage et al. discloses a case for a modular tablet computer system. This enclosure is a housing for raw electronics that have been specially designed to fit the enclosure, it is not an enclosure that a user can attach to any input device.

U.S. Pat. No. 6,000,665 to Clementson et al. discloses a support device for a small palm sized computer. This device improves the ergonomic properties of a palm sized computer by enlarging the gripping and support area. This device does not offer any novel means of gripping, nor does it have any type of side adjustable support edges to fit different size devices.

U.S. Pat. No. 5,667,114 to Bourque discloses a carrying device for a portable computer. This device is a computer supporting platform that hangs on straps looped around a user's neck. While this device solves the problem of an ergonomically incorrect wrist angle it puts the input device in a static position relative to the user which makes it difficult to use in a place such as a vehicle or a tight work space.

European Pat No. EP 0 734 694 A2 to Castellini discloses a dentist tablet with an ergonomic handle. This handle is designed to allow a device with light touch input buttons to be used with one hand gripping the handle while touching the input surfaces of the device with a finger of the gripping hand leaving the other hand free for other work. This concept works for simple push inputs but does not work with a tablet computer type device which requires the more complex operation of an entire input tablet rather than just light touch buttons.

BRIEF SUMMARY OF THE INVENTION

The Ergonomic Input-Device Holder described herein allows for a more ergonomic way to grip an input device and thereby reduces the risk of wrist injuries. An input device is secured to the top side of the Input-Device Holder and the non-preferred hand of the user grips an ergonomic pistol-grip handle on the bottom side of the Input-Device Holder. The user's hand is further supported by a pair of wrist supports to which the user can strap his wrist for added support and stability.

DETAILED DESCRIPTION OF THE INVENTION

Figures 1, 2, 3, 4:
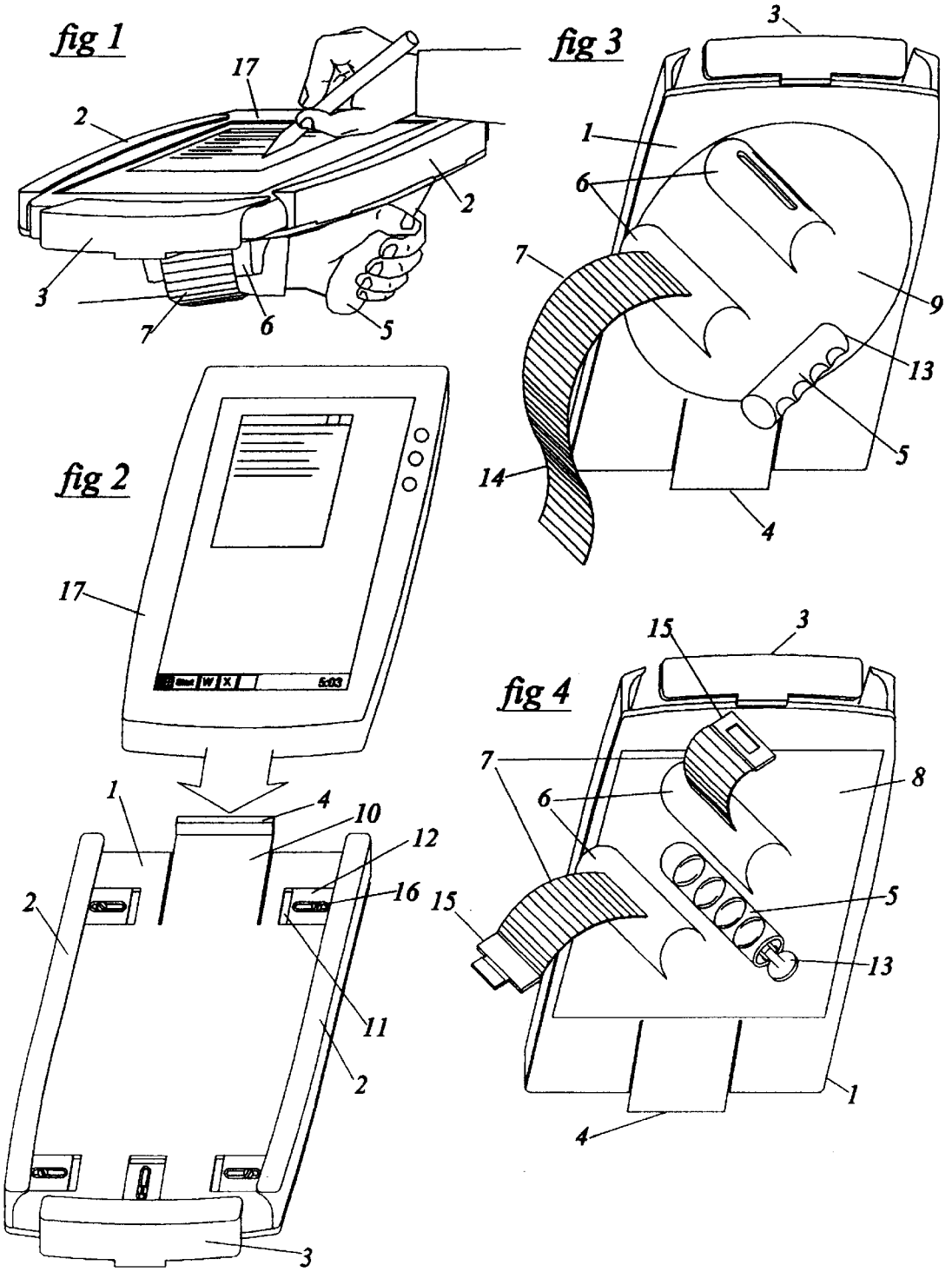
FIG. 1. shows the Input-Device Holder in use with the users non-preferred hand strapped to the wrist supports on the bottom side and the users preferred hand operating the input device.
FIG. 2. shows the Input-Device Holder viewed from the top with an input device in position to be inserted into the Input Device Holder.
FIG. 3. shows the Input-Device Holder viewed from the bottom with a circular bottom plate and a single strap arrangement, and with the handle in a folded out into use position.
FIG. 4. shows the Input-Device Holder viewed from the bottom with a square bottom plate and a two-strap-and-buckle arrangement, and with the handle folded down into storage position.

The components of the input-device holder are the board (1), the side supports (2), the bottom support (3), the top support (4), the handle (5), the wrist supports (6), the strap connection (7), the optional bottom plate than can be a square bottom plate (8) or a circular bottom plate (9).

The board (1) is made up of a mainly flat member with a springboard tongue (10), the end of the tongue (10) has a rising ridge that makes up the top support (4). The springboard tongue (10) is such that the top support (4) can be pushed down by hand until the top of the top support (4) is level with the top surface of the board (1). The top of the board (1) has a number of tracks (11) in which the bottom support (3) and the side supports (2) are attached by means of tongue shaped sliders (12) that fit in the tracks (11) where the sliders can be attached at various positions along a linear path by means of setting screws (16) or some other standard fastening method to allow for different settings of the side supports (2) and the bottom supports (3).

On the bottom side of the board (1) a bottom plate (8 and 9) is attached. A handle (5) is attached to the bottom plate (8 and 9) by means of a hinged joint (13). The handle (5) can be folded down to a position between the two wrist supports (6) as seen in FIG. 4 or be folded up into the use position as seen in FIG. 3.

Two wrist supports(6) are part of the bottom plate or may be separate physical units attached to the bottom plate(8 and 9) by means of standard fastening methods. The two wrist supports(6) are connected by a strap connection(7), the strap connection(7) completes the connection by means of standard strap connection methods such as a single strap(14) as seen in FIG. 3 with hook and loop fastener or a double strap with a standard buckle(15) as seen in FIG. 4 or some other standard strapping method.

In the case of a square bottom plate (8) the plate can be attached to the bottom of the board (1) at a 0 degree angle, 90 degree angle, 180 degree angle, or a 270 degree angle by means of standard non permanent fastening methods such as screws, bolts, or clips. The square bottom plate (8) can be removed and reattached to the board (1) at above said angles.

In the case of a circular bottom plate (9) the plate is attached to the bottom of the board (1) by means of a standard rotational joint arrangement and can rotate to any angle and be secured at that angle.

Operation:

The sliders (12) are secured in the tracks (11) by means of the setting screws (16) at positions where the side supports (2) and the bottom support (3) that are attached to the sliders (12) fit the intended input device snugly.

The top support (4) is pushed down by hand to a point where the top of the top support (4) is level with the top surface of the board, the input device (17) is then slid in between the two side supports (2). When the bottom of the input device reaches the bottom support (3) the top support (4) will snap up behind the top of the input device and keep the input device in place.

The handle (5) is then folded out from storage position as seen in FIG. 4 to use position as seen in FIG. 3.

The user then places the wrist of his/her non-preferred hand between the two wrist supports (6), closes the strap connection (7) across his/her wrist and grabs the handle (5). The user can now operate the input device with his/her preferred hand.

I claim:

1. An input device holder comprising:

a. a board roughly the size and shape of the bottom surface of an input device for which said input device holder is intended for, where said input device is attached to the top side of said board, and a hand of the user of said input device supports the bottom side of said board, where said board is of a shape having 4 corners that are not required to be sharp and where said board is roughly rectangular in shape with 2 longer sides and 2 shorter sides;

b. 2 side supports on the top side of said board that secure said input device to said board each comprised of a rail structure attached to opposite sides from each other along said longer sides of said board;

c. a bottom support on the top side of said board that secures said input device to said board comprised of a rail structure attached to said board along one of said shorter sides of said board;

d. a top support on the top of said board that secures said input device to said board comprised of a rail structure attached to said board along one of said shorter sides of said board;

e. a pistol grip handle on the bottom of said board positioned such that a user can grip said handle at an ergonomically correct angle with the supporting hand leaving the free hand free to operate said input device;

f. 2 wrist supports on the bottom of said board each comprised of a mound structure positioned in such a way that said wrist supports are on 1 side each of the wrist of the supporting hand of the user when the user is gripping said handle with the supporting hand;

g. a strap connection between the 2 said wrist supports that secures the users wrist to said board.

2. The input device holder of claim 1 wherein said handle and said wrist supports are located on a separate bottom plate where said bottom plate has means for attaching to said board at different angles in relation to said board to accommodate both right-handed and left-handed users and also allow for said input device attached to said input device holder to be used at different angles and where a surface of said bottom plate that does not have said wrist supports and said handle attached to said surface is in contact with the bottom side of said board when said bottom plate is attached to said board.

3. The bottom plate of claim 2 wherein said bottom plate is square in shape and attaches to the bottom of said board with 4 different angular possibilities allowing for both left-handed and right-handed users as well as both portrait and landscape orientation of said input device attached to said input device holder.

4. The bottom plate of claim 2 wherein said bottom plate is circular in shape and attaches to the bottom of said board in the geometric center of said bottom plate and can be rotated to and secured at any angle to said board allowing for both left-handed and right-handed users as well as any angle orientation of said input device attached to said input device holder.

5. The input device holder of claim 1 wherein said side supports include means for adjusting sideways along a linear path to allow for different size input devices to be attached to said input device holder.

6. The input device holder of claim 1 wherein said bottom support includes means for adjusting up and down along a linear path to allow for different size input devices to be attached to said input device holder.

7. The input device holder of claim 1 wherein said top support is comprised of a tongue shaped springed member with a ridge on outer tip of said tongue shaped springed member where said ridge holds an input device attached to said input device holder in place and may be pushed down manually by the user to remove or insert said input device attached to said input device holder.

8. The input device holder of claim 1 wherein said handle is hinged so that said handle can be folded down into the space between said wrist supports to allow for smaller size when not in use.

9. The input device holder of claim 1 wherein said strap connection is comprised of 1 strap or 2 straps traversing the entire distance between said wrist supports closing the gap between said wrist supports while being such that the length of the strap connection is adjustable to accommodate different wrist sizes by means of buckles or hook and loop fastener.

* * * * *